US005088418A

United States Patent [19]

Reckermann et al.

[11] Patent Number: 5,088,418

[45] Date of Patent: Feb. 18, 1992

[54] TRANSPORT PALLET

[75] Inventors: Hans-Dieter Reckermann, Vlotho; Wolfgang Berkenkamp, Bad Oeyhnhausen, both of Fed. Rep. of Germany

[73] Assignee: Rebo-Plastic GmbH & Co. KG, Kalletal-Erder, Fed. Rep. of Germany

[21] Appl. No.: 556,085

[22] Filed: Jul. 20, 1990

[30] Foreign Application Priority Data

Aug. 4, 1989 [EP] European Pat. Off. ..... 89114430

[51] Int. Cl.[5] ..... B65D 19/38

[52] U.S. Cl. ..... 108/51.1; 108/53.1; 108/55.3; 108/901; 108/56.1

[58] Field of Search ..... 108/51.1, 53.1, 53.5, 108/55.1, 55.3, 55.5, 56.1, 901; 206/386, 599, 600

[56] References Cited

U.S. PATENT DOCUMENTS

| | | | |
|---|---|---|---|
| 3,747,780 | 7/1973 | Schneider | 108/55.3 X |
| 4,000,704 | 1/1977 | Griffin, Jr. | 108/53.3 X |
| 4,254,487 | 3/1981 | Cook, III et al. | 108/55.3 X |
| 4,366,905 | 1/1983 | Forshee | 206/600 X |
| 4,735,321 | 4/1988 | Day | 108/55.5 X |
| 4,756,413 | 7/1988 | Gits | 206/600 X |

*Primary Examiner*—Peter A. Aschenbrenner
*Attorney, Agent, or Firm*—Goodman & Teitelbaum

[57] ABSTRACT

The present invention relates to a transport pallet consisting of a base pallet (1) with a bottom inlay member (2) insertable snugly therein, and a cover (3), in which system the bottom inlay member (2) and the cover (3) have receptacles (14) on their facing sides for the support of objects (8), which are to be transported, arranged between them when fitted together, and the pallet individual parts (1, 2, 3) are constructed as synthetic material deep-drawn shaped parts.

12 Claims, 3 Drawing Sheets

TRANSPORT PALLET

Figure 1:
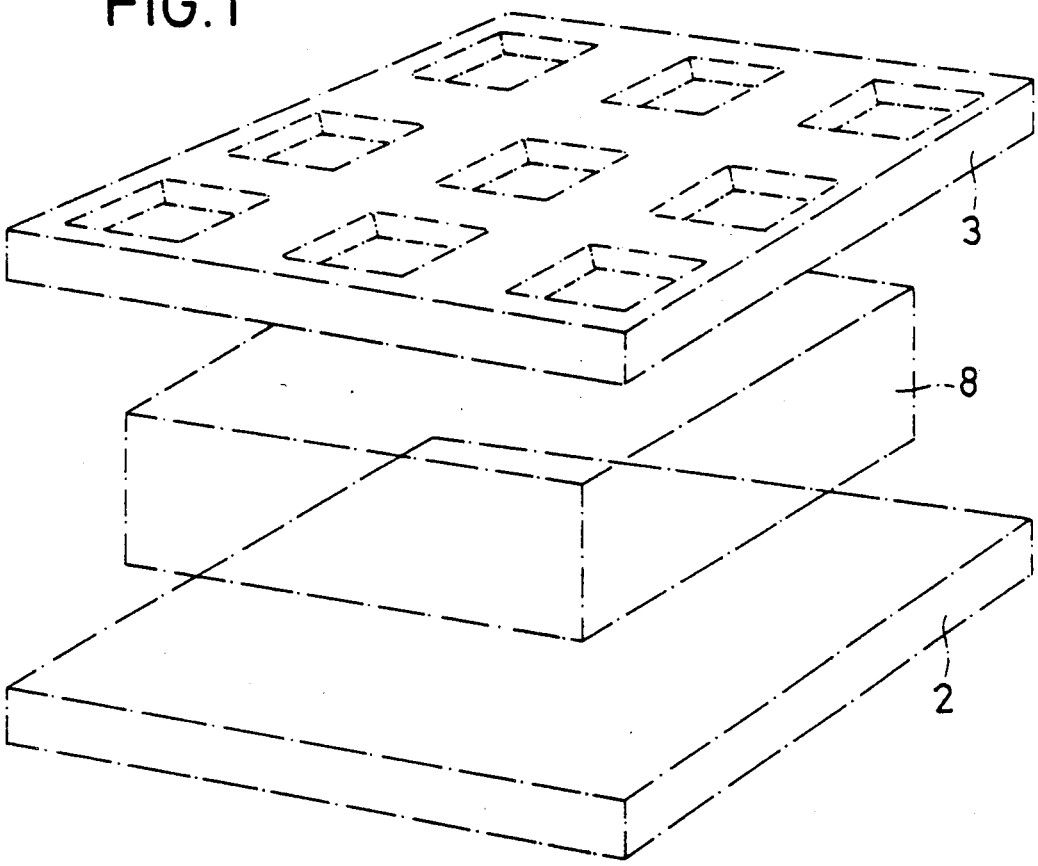
Figure 1:
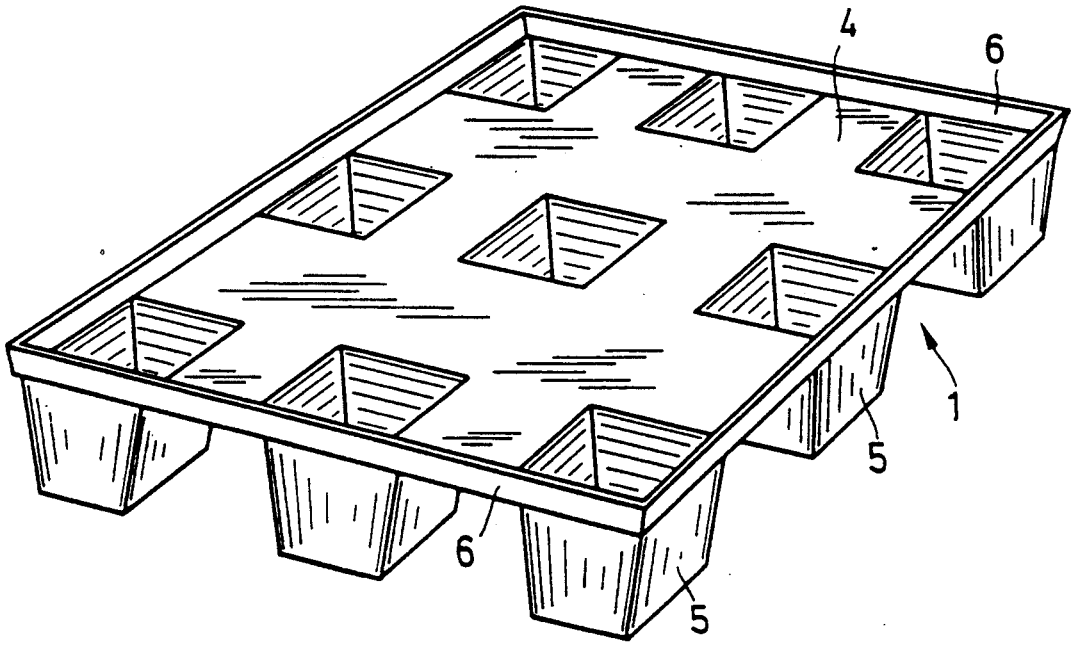

The present invention relates to a transport pallet with which, for example, components of motor vehicles can be transported from the manufacturer of the components to the assembling place of the same.

Underlying the invention there is the problem of creating a pallet which permits a transport of the parts to be transported by it from the production place of the parts to the place of installation without there being necessary a reloading of the parts and with which an exactly defined position of the parts on the pallet is assured, and also provides a safe, damage-free transport of the parts to their destination as well as a space-saving return transport of the empty pallet.

According to the invention this problem is solved by a transport pallet which consists of a base pallet with a bottom inlay member snuggly insertable in this and a cover, in which system the bottom inlay member and the cover have on their sides facing one another receptacles for the support of objects to be transported arranged between them when fitted together and also the individual parts of the pallet are constructed as plastic deep-drawing shaped parts. By the construction of the transport pallet according to the invention, from a base pallet, a bottom inlay member and the cover there is yielded the possibility that the parts to be transported can be deposited during their production right after conclusion of the manufacturing process on the bottom inlay member, and, namely, in the position in which, for example, the removal of a layer is to take place by a robot or the like at the assembling place, i.e. by the fitted together arrangement of the parts on the bottom inlay member a quite definite alignment can be made already in respect to the later further processing. Moreover, the bottom inlay members can be deposited independently of the base pallet on assembly belts in order then to be used for the further transport into the base pallet, and, namely, with the parts to be transported already present on them. By the cover that is provided according to the invention there occurs a covering of the parts to be transported from above and, if need be, also in the side portion, whereby there is achieved a protection against damage and simultaneously an additional fixing in position. According to the invention, accordingly, there is created by the pallet a transport unit closed in itself. For the removal of the parts to be transported, the cover is removed and the parts are taken out together with the inlay bottom member from the base pallet and can again be deposited on an assembly belt. The empty pallet can then be returned with or without the bottom inlay member, the space requirement being substantially reduced, since the individual pallet parts can be stacked independently of one another.

Further, it can be advantageous according to the invention if on the under-side of the base pallet there are formed feet and on the upper side of the cover there are formed receptacles for the support of the feet when fitted together. Thus, several transport pallets according to the invention can be arranged one over another, in which process there is achieved a secure fixing of the pallets in position against one another. Further, it can be advantageous according to the invention if there is arranged at least one intermediate inlay member between the bottom inlay member and the cover, this intermediate inlay member having receptacles formed on both sides for the support of the objects to be transported when fitted together. Through this intermediate inlay member there can be made a multi-layer arrangement of the parts to be transported.

Advantageous executions of the invention are explained with the aid of the appended drawings.

Figure 2:
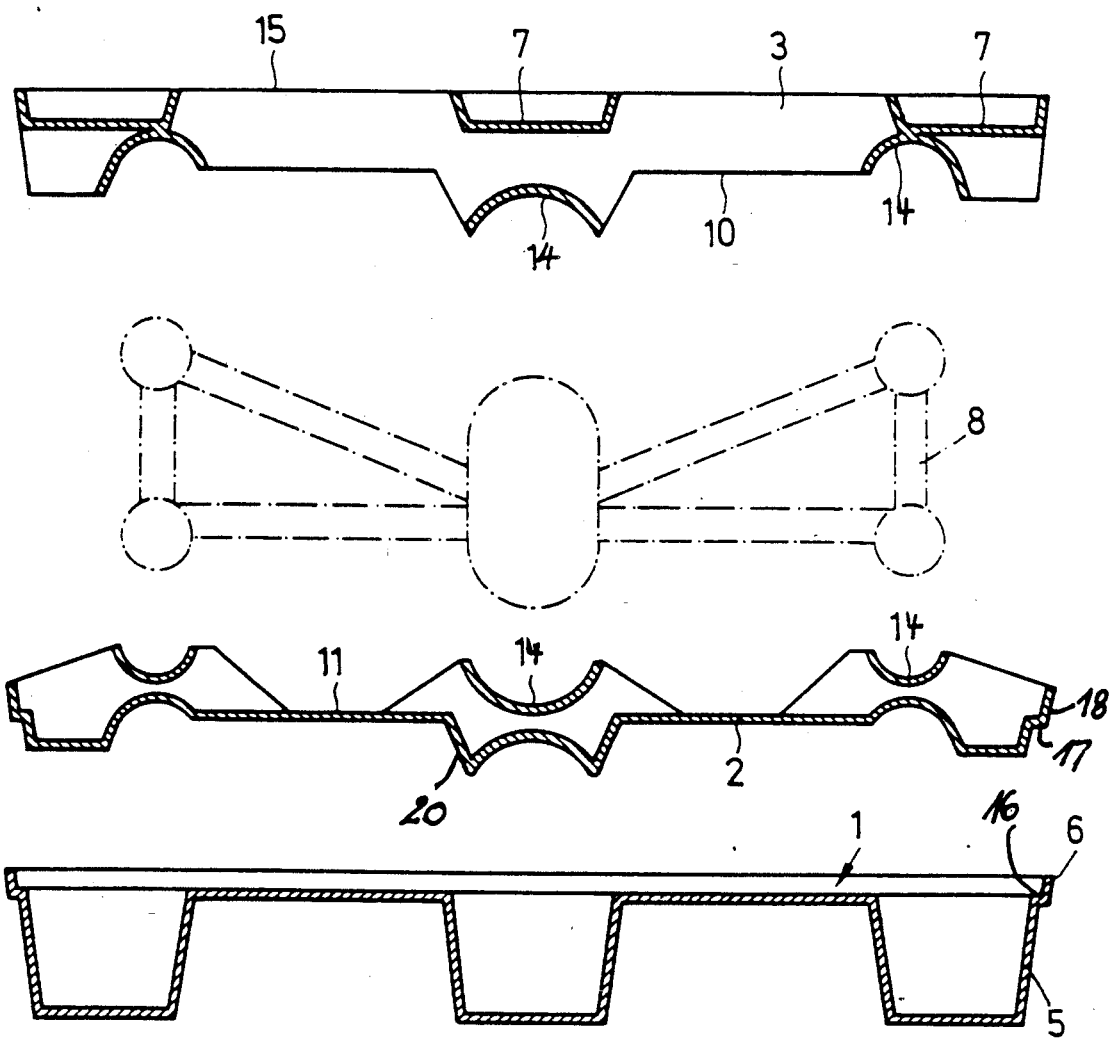
Figure 3:
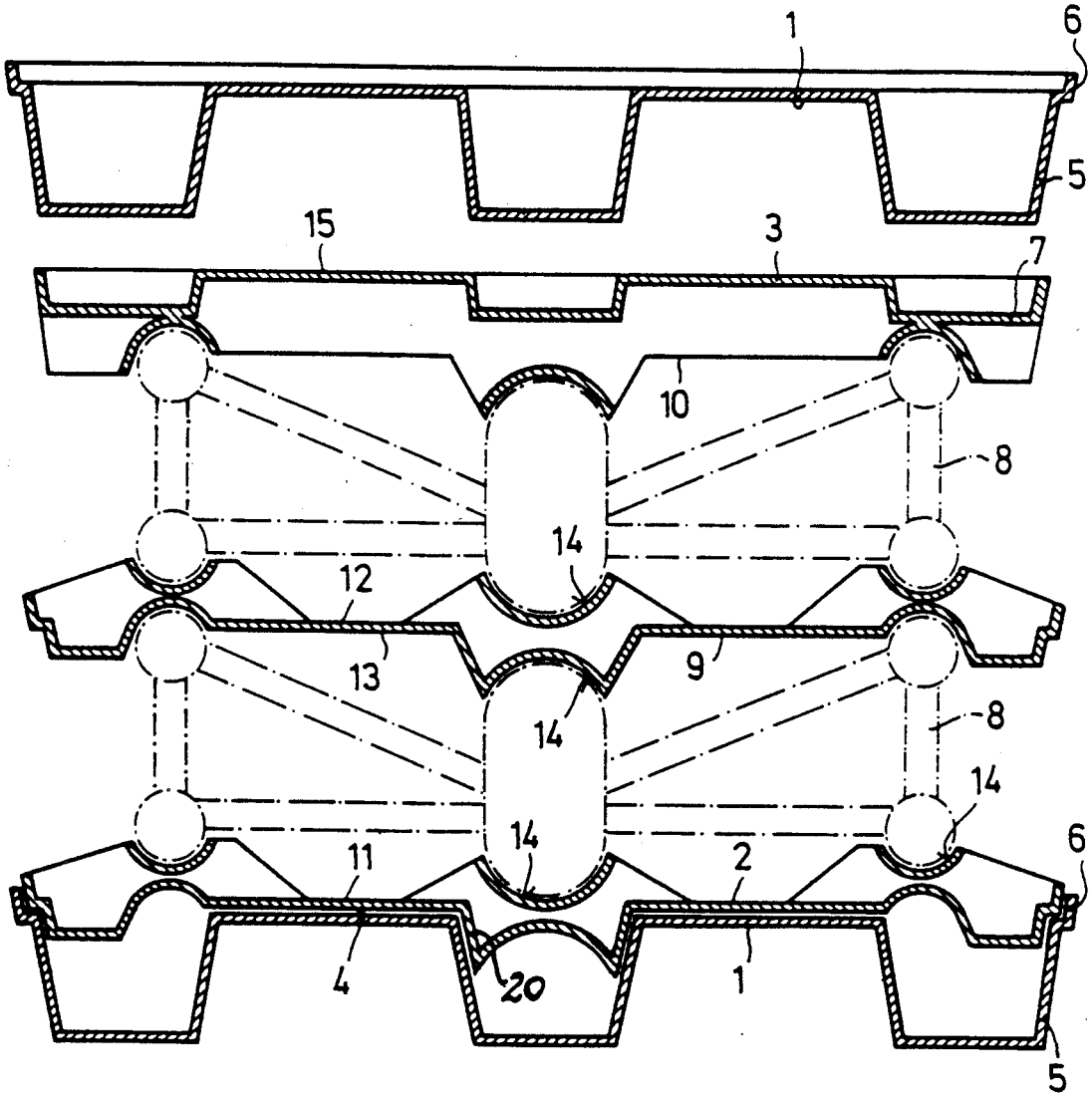

FIG. 1 shows in schematic representation the structure of a transport pallet according to the invention, FIG. 2 shows the construction in section of an embodiment by way of example of a transport pallet according to the invention in unassembled state of the individual parts, FIG. 3 shows a section according to FIG. 2, in which the pallet is shown in the transport state.

As is yielded from FIG. 1, a transport pallet according to the invention consists of a base pallet 1, a bottom inlay member 2, which in the example of execution can be laid on the base pallet, and fixed in this when fitted together, as well as a cover 3, in which system objects 8 to be transported with the transport pallet are stored and supported between the bottom inlay member 2 and the cover 3. The base pallet 1, the bottom inlay member 2 and the cover 3 are constructed according to the invention as plastic deep-drawn shaped parts, whereby there is yielded an economical manufacture and a low weight. The base plate 1 consists of a substantially flat bottom 4, in which feet 5 are formed. These feet 5 are constructed as truncated pyramidal hollow bodies and are open to the bottom 4. It likewise lies within the scope of the invention to give the bottom 4 a negative contour in such a way that it corresponds to the outer form of the bottom inlay member 2. In the example of execution represented there are present altogether nine feet 5, and, namely, in each case three rows with three feet 5 each. Further, the base pallet has a border strip 6 formed on the circumference of the bottom 4, the bottom having a surrounding support edge 16 in the region bounding on the border strip 6. The border strip 6 forms with the horizontal support edge 16 preferably an obtuse angle, so that the opening comprised by the border strip 6 expands in an inclined upward direction. The bottom inlay member 2 is constructed in such a manner that, in the installed state, with a surrounding, especially a horizontal, support portion 17 constructed on its under-side, it rests on the support edge 16. Further, the bottom inlay member 2 has a side-wall section 18 which is formed in such a manner that this is enclosed by the border strip 6 when fitted together in the installed state, so that the bottom inlay member 2 is fixed on the base pallet 1. The side-wall section 18 forms here with the support portion 17 a step-form-transition, in which the side-wall section 18 forms with the support portion 17 an obtuse angle which is adapted to the obtuse angle between the border strip 6 and the support edge 16. Thus, there is yielded a self-centering of the bottom inlay member 2 in the base pallet 1 in the installation of the same. Accordingly the fixing of the bottom inlay member 2 in the base pallet 1 is independent of the form of the parts to be stacked. The cover 3 is adapted in its dimensions in correspondence to the base plate 1 and includes, on its upper side receptacles 7 for the feet 5 of the base pallet 1, so that the feet 5 are secured against slipping in the receptacles 7, preferably by a fit together framing. Thus, it is possible to securely place on the cover 3 the base pallet of another transport pallet according to the invention, so that there can be formed a stack of several transport pallets according to the invention. The entire transport pallet of the invention can be additionally stabilized by the means that a locking band is firmly secured around the pallet, i.e. around the base pallet 1 and the cover 3.

While in FIG. 1 the principle of the invention is represented, FIGS. 2 and 3 show a special development in adaptation to the form of the object 8 to be transported. Here it is represented in FIGS. 2 and 3 how the object 8 to be transported is itself drawn into the carrying function of the transport pallet, as the cover 3 and an intermediate layer member 9 lie on the object 8. For this the sides 10, 11 of the cover 3 and of the bottom inlay member 2 facing the object 8 as well as the upper side 12 and the lower side 13 of the intermediate inlay member 9 are formed in such a way that in each case receptacles 14 are provided for the bearing of the object 8 in certain places when fitted together. Here, the receptacles 14, especially on the bottom inlay member 2 as well as on the intermediate inlay member 9 are such that the objects borne therein are automatically supported without lateral bracing or fixing from above, so that the bottom inlay member 2 or the intermediate inlay member 9 with objects provided on them are transportable, for example, independently on transport belts. It is expedient here if the intermediate inlay member 9 and the bottom inlay member 2 have an identical construction to each other. Further, it is to be perceived, that into the receptacles 7 on the upper side 15 of the cover the base pallet 1 is snuggly insertable with its feet 5, so that a stackability is achieved. Moreover, it is expedient if the bottom inlay member 2 is constructed on its underside facing the base pallet 1 with projections 20 for the reception of the objects to be transported in such a way that these projections 20 extend into the hollow spaces of the hollow feet 5 and are grasped by the foot walls in especially a force-fit arrangement.

As for the formation of the base pallet 1 as well as of the bottom inlay member 2, this is advantageously such that independently of the formation of the bottom inlay member 2 in dependence on the form of the objects 8 to be transported the base pallet 1 is unaltered, so that any of the bottom inlay members 2 fit into the base pallet 1. Moreover, there is yielded by the invention the possibility of stacking the base pallet(s) 1 in one another and over one another for the return transport, whereby the requisite space requirement is reduced.

In the example of execution represented the objects to be transported are held in the bottom inlay member 2, or in the intermediate inlay member 9 and/or the cover when fitted together. According to the invention, however, there can also occur a support by a force-fit arrangement alone or additionally.

It lies likewise in the scope of the invention if the bottom inlay member 2, the intermediate inlay member 9 and the cover 3 are constructed on their sides facing one another and have corresponding projections, in such a way that a supporting on one another can occur, in which case, then, a support on the object 8 itself is not required. I.e., in the intermediate inlay members or the bottom inlay members there are created so-called nests for the reception of the objects to be transported.

The synthetic material used for the transport pallet of the invention is a thermoplastic synthetic material that is suited for deep drawing.

What is claimed is:

1. A transport pallet comprising:

a base pallet (1), a cover (3) and a bottom inlay member (2) disposed between said base pallet (1) and said cover (3) so that a side (10) of said cover (3) faces a side (11) of said bottom inlay member (2):

said bottom inlay member (2) being snugly inserted in said base pallet (1);

said bottom inlay member side (11) and said cover side (10) including receptacle means (14) for supporting objects (8) which are being transported, the objects (8) being arranged between said bottom inlay member (2) and said cover (3); and said base pallet (1), said bottom inlay member (2) and said cover (3) being constructed as synthetic material deep-drawn shaped parts.

2. A transport pallet according to claim 1, wherein feet (5) are provided on an underside of said base pallet (1), and receptacles (7) are provided on an upper side of said cover (3) for receiving and securely holding said feet (5).

3. A transport pallet according to claim 2, wherein said feet (5) are constructed as truncated pyramidal hollow bodies.

4. A transport pallet according to claim 2, wherein extensions (20) are provided on an underside of said bottom inlay member (2) for reception of the objects (8) which are being transported, said extensions (20) extending into said feet (5) which are constructed as hollow bodies.

5. A transport pallet according to claim 1, wherein at least one intermediate inlay member (9) is disposed between said bottom inlay member (2) and said cover (3), said receptacle means (14) also being provided on opposing sides (12, 13) of said intermediate inlay member (9) for supporting the objects (8) which are being transported, said intermediate inlay member (9) being constructed as a synthetic material deep-drawn shaped part.

6. A transport pallet according to claim 5, wherein said bottom inlay member (2) and said intermediate inlay member (9) have the same identically shaped construction.

7. A transport pallet according to claim 1, wherein said base pallet (1) includes a substantially flat bottom (4) and a border strip (6) surrounding said flat bottom (4).

8. A transport pallet according to claim 7, wherein said flat bottom (4) has a support edge (16), said support edge (16) forming an obtuse angle with said border strip (6), said bottom inlay member (2) being enclosed by said border strip (6) when said bottom inlay member (2) is seated on said support edge (16).

9. A transport pallet according to claim 8, wherein said bottom inlay member (2) includes a side wall section (18) having a predetermined configuration which is enclosed by said border strip (6) in an installed state, so that said bottom inlay member (2) is securely fixed on said base pallet (1).

10. A transport pallet according to claim 9, wherein said side wall section (18) of said bottom inlay member (2) forms a step-form transition with a support portion (17) provided on an underside of said bottom inlay member (2), said side wall section (18) forming a second obtuse angle with said support portion (17), said second obtuse angle matching said obtuse angle formed by said border strip (6) and said support edge (16) of said base pallet (1).

11. A transport pallet according to claim 1, wherein the objects (8) which are being transported are supported within said pallet by a securement arrangement.

12. A transport pallet according to claim 1, wherein the objects (8) which are being transported are secured within said pallet by a force-fit arrangement.

* * * * *